US005902400A

United States Patent [19]

Zimmer

[11] Patent Number: 5,902,400

[45] Date of Patent: May 11, 1999

[54] APPLICATOR DEVICE

[76] Inventor: Johannes Zimmer, Ebentaler Strasse 133, 9020 Klagenfurt, Austria

[21] Appl. No.: 09/051,810

[22] PCT Filed: Oct. 17, 1996

[86] PCT No.: PCT/EP96/04492

§ 371 Date: Sep. 21, 1998

§ 102(e) Date: Sep. 21, 1998

[87] PCT Pub. No.: WO97/14561

PCT Pub. Date: Apr. 24, 1997

[30] Foreign Application Priority Data

Oct. 17, 1995 [DE] Germany ..... 295 17 098 U

[51] Int. Cl.[6] ..... B05C 1/00

[52] U.S. Cl. ..... 118/118; 118/119; 118/123; 118/126; 118/413; 118/414; 118/419; 427/356; 427/359

[58] Field of Search ..... 118/118, 119, 118/123, 126, 413, 414, 419; 427/356, 359; 101/120

[56] References Cited

FOREIGN PATENT DOCUMENTS

| | | |
|---|---|---|
| 296927 | 3/1972 | Austria . |
| 392745 | 5/1991 | Austria . |
| 311728 | 4/1989 | European Pat. Off. . |
| 504501 | 9/1992 | European Pat. Off. . |
| 534581 | 3/1993 | European Pat. Off. . |
| WO90/07387 | 7/1990 | WIPO . |

*Primary Examiner*—Laura Edwards

*Attorney, Agent, or Firm*—Fay, Sharpe, Beall, Fagan, Minnich & McKee

[57] ABSTRACT

The invention concerns a device (1) for applying a substance (9) to a surface (3), the device comprising a carrier beam (2) and a doctor blade unit (40) which can be pressed magnetically against the surface (3). Provided between the doctor blade unit (40) and the carrier beam (2) is a holder connection (5) which produces play transversely to the surface (3). The holder connection (5) comprises at least one pair of sliding holder elements (51, 52) which can move only in translation, interact and form a sliding guide plane (500) which can be aligned on the region of the doctor blade element application zone (31). The holder elements are interconnected in a manner rigid against tilting such that all the moments due to thrust forces on the doctor blade unit (40) act with respect to a point of application on the carrier beam without losses of moments.

21 Claims, 5 Drawing Sheets

Figures 1, 2, 3:
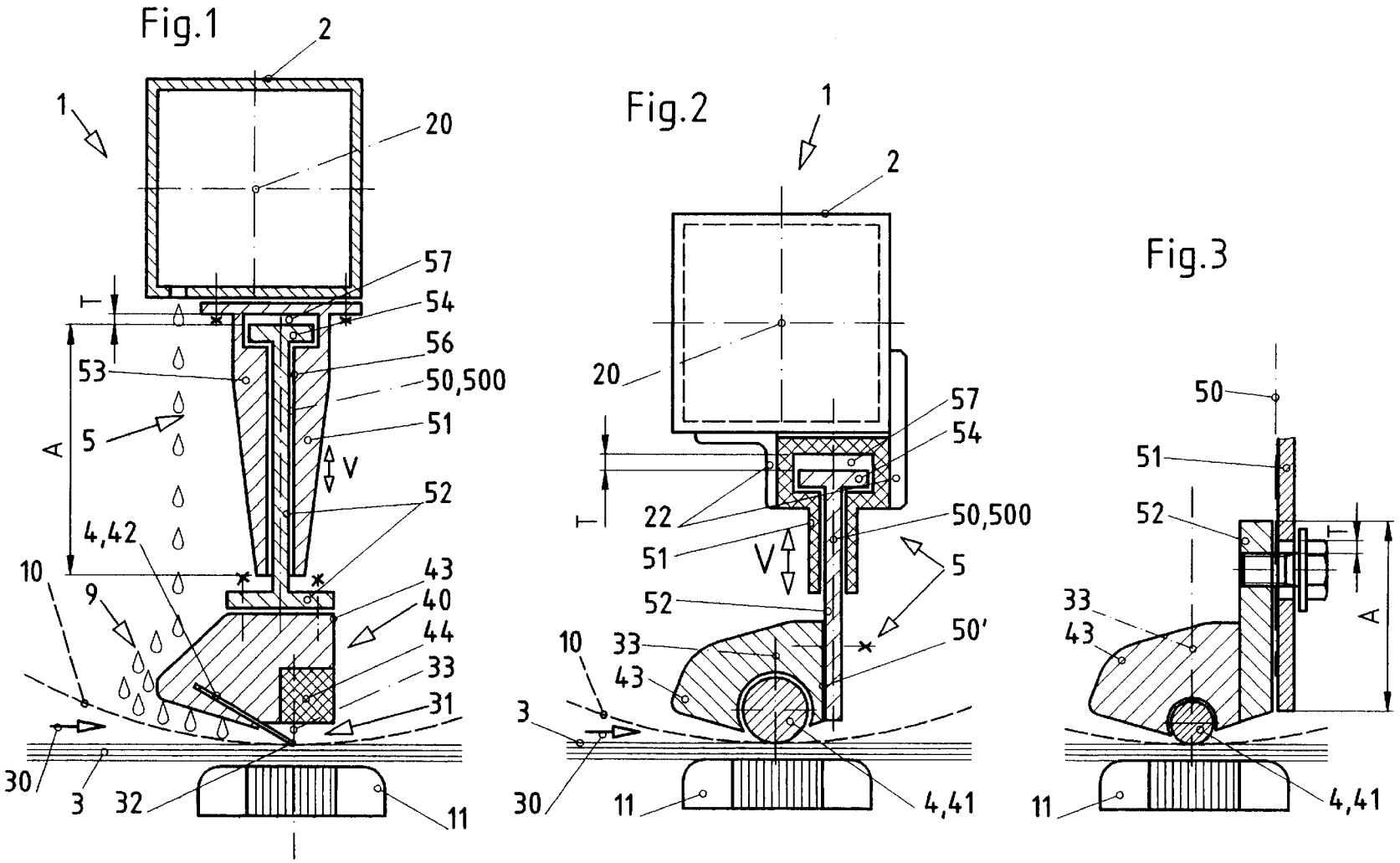

1
2
20
57
54
56
50,500
51
52
43
40
44
33
31
11
V
53
5
4,42
9
10
30
3
32
22
50'
4,41
50

A
20
6
66
76
74
73
51
5
52
72
30
71
67
621
43
61
62
44
10
3
11
2
50
9

APPLICATOR DEVICE

The invention concerns an applicator apparatus for applying substance to an application surface such as a web or the like moved relative to the apparatus with a carrier beam extending in the longitudinal direction of the apparatus over the application width, with a doctor holding portion supporting a roll doctor or doctor blade element, the doctor element and the doctor holding portion forming a doctor unit that is magnetically pressable against the application surface, and with a holding connection that produces play in a direction transverse to the application surface between carrier beam and doctor unit.

It is known from an apparatus of corresponding type (EP-A-0 504 501) to hang a doctor holding portion on a carrier beam with a single-armed connection. The doctor holding portion is formed and arranged such that the corresponding doctor element is at least marginally slidably movable inside the doctor holding portion with all degrees of freedom transverse to the doctor device longitudinal axis. It has been shown that instabilities can arise. The doctor holding portion is provided pivotally hinged on the holding arm by means of a slide and clatter joint to enable the carrier beam to be displaced parallel to the application surface for positioning the doctor. The doctor element must be flexibly mounted and the device in unsuitable for use in rotary screens.

In another known device (AT-B-392 745) the doctor holding portion is hinged for rotation. By means of the hinge connection the doctor unit is to be self positioning as a result of the magnetically generated pressing force. It is true that the position of the doctor element is brought about automatically by magnetic force. However, under operating conditions the doctor holding portion tends to diverge sideways undesirably. In practice, special additional measures are necessary to position the doctor device. For example the machine assembler helps himself by providing special positioning clips.

The invention has the object to provide an application apparatus with improved positioning and stabilising of the doctor element in order to avoid laborious pre- and post adjustment using supplementary elements and to improve the application quality; at the same time the connection between carrier beam and doctor element should be particularly simple, compact and comfortable to use.

The object is achieved in combination with the features of the apparatus mentioned in the introduction in that the holding connection between carrier beam and doctor element comprises at least a pair of exclusively translatorily movable, mutually engaging sliding holder elements which form a sliding guide plane adjustable to the region of the zone of contact of the doctor element, the sliding holder elements being tilt-resistantly connected together such that the moments, which arise as a result of the thrust acting on the doctor unit during doctor operation, act without loss of moment with regard to a point of application on the carrier beam. The connection of the doctor holding portion with the carrier beam according to the invention is a telescope-like glide-sliding connection of sliding holder elements that forms a sliding guide connected to resist rotation to the carrier beam, the sliding guide holding the doctor holding portion slidingly movable along a bearing plane that extends parallel with the apparatus longitudinal axis and is alignable with the area of the contact zone of the doctor element. The doctor holding portion is rigidly connected with the carrier beam with respect to the thrust which acts on the doctor holding portion during doctor operation, the doctor holding portion being translationally slidable along the sliding guide plane perpendicular or nearly perpendicular to the application surface by means of a magnetic pressing force applied to it. The telescope-like sliding guide according to the invention permits the carrier beam to be held both freely pivotable and also not rotatable in the carrier beam bearing. It has been found that conventional application/printing errors and/or defects that arise as a result of only small pivotal movement of the doctor holding portion are effectively obviated with the stabilizing achieved according to the invention.

To obtain a tilt-resistant connection of the doctor holding portion with the carrier beam there can advantageously be provided a longly overlapping layered rear sliding closing sit of a holding arm connected to the carrier beam to resist rotation and of a holding arm connected to the doctor holding portion to resist rotation, both arms of preferably the same length extending through the space between carrier beam and doctor holding portion and advantageously overlapping one another over the major part of their approximately equal lengths.

Advantageously the carrier beam can be held for free pivotal movement in order that it may carry out magnetic self-positioning, its pivot position subsequently being holdable by fixing the carrier beam. The magnetic self-positioning is maintained in the predetermined guide plane, the positioning at the start of operation and during operation of an application device being substantially improved.

Doctor holding portion and doctor element form a doctor unit such that the doctor element is connected by friction-type engagement with the doctor holding portion transverse to the application surface at least during the doctor operation. The doctor holding portion, e.g. in the form of a holding strip or the like for a doctor roll or doctor blade that may be pressed by magnetic force in the region of the substance application zone, is captively connected with the carrier beam. The doctor element is usefully bound by a detachable sliding, plug or join connection with the doctor holding portion and forms together with the latter the magnetically pressable doctor unit which forms a component part of the application apparatus that may be handled as a single piece.

A particularly advantageous arrangement of the invention consists in that the connection of the doctor unit with the associated sliding holder element, the sliding holder elements with one another and/or the carrier beam with the associated sliding holder element is provided in a modular construction as a detachable plug, hook and/or sliding connection. Such a connection usefully comprises a support wall for the doctor holding portion formed by means of the sliding holder elements and extending from the carrier beam into the region of the application surface. This connection comprises at least a doctor holding portion holding arm and a carrier beam holding arm as a sliding holder element, the doctor holding portion holding arm and carrier beam holding arm being formed by wall plates of a width corresponding to the application width and usefully engage one another in the manner of a tongue and groove connection in combination with the overlapping connection of the arms between carrier beam and doctor holding portion. The tongue and groove connection is provided as a sliding fit in a direction transverse to the application surface, whereby the sliding movability of the doctor holding portion transverse to the application surface and along the multiple arm sliding guide is attained. The plug, hook and sliding connection of the doctor holding portion with the carrier beam can usefully also be formed by socket bolts engaged in slots to provide the sliding guidance transverse to the application surface.

A particular advantage of the preferred loose plug, hook, rail and/or sliding connection of the doctor holding portion with the carrier beam consists in that in one and the same apparatus very different doctor holding portions can be used simply by exchange. In this way the application apparatus according to the invention can be equipped for different requirements and applications with doctor elements of different types that may be comfortably and rapidly exchanged, and if necessary a doctor unit with a likewise preferably exchangeable doctor roll element or doctor blade element can be provided. This building block system offers an substantial improvement in practice.

The doctor holding portion is preferably provided as a strip with a magnetizable mass, the magnetizable mass being arranged such that in every working position of the doctor holding portion, when viewed in profile strip cross section and in the direction of movement of the application surface, it lies fully or at least predominantly in the region behind the device plane that is perpendicular to the working surface and defined by the doctor element contact line. A flat or round rod inset or embedded in the doctor holding portion has proved to be particularly advantageous. Preferably the lower narrow edge of a flat rod, relative to the profile cross sectional height, extends in the proximity of the doctor element, and a magnetizable flat rod is permanently arranged in a steep diagonal position relative to the application surface. Such an arrangement is particularly advantageous in combination with a round rod doctor of relatively small diameter of about 5 to 12 mm set in the doctor holding portion.

An advantageous embodiment of the invention consists in that the doctor holding portion is a rotary profile strip that is held to move pivotally about two bearing axles extending in the apparatus length, the first pivot bearing axle being formed by an axle that lies in, or proximate to, the sliding guide plane and in the region of the doctor element contact zone, and the rotary profile strip being hinged by means of the second pivot bearing axle to a coupling member that is coupled to the carrier beam by at least a further pivot bearing axis extending in the apparatus length. Thus in the embodiment of the invention the rotary profile strip is provided to be translationally slidingly movable along the sliding guide connected to the carrier beam to resist rotation. By means of this sliding pivotal coupling of the doctor holding portion on the carrier beam, the doctor holding portion is movable with two independent degrees of freedom. A disadvantageous positioning displacement in or against the direction of working movement, such as arises with conventional apparatus with rotary profile strips particularly owing to undesired sequential pivotal movements is prevented.

Sub-claims are directed to still further useful and advantageous embodiments of the invention and some particularly useful and advantageous embodiments or arrangement possibilities of the invention will be described in more detail by the following description of the embodiments shown in the schematic drawings. These show FIGS. 1 to 8 application apparatuses according to the invention in partial profile section with doctor holding portions mounted exclusively for translational movement on the carrier beam holding arm FIGS. 9 to 13 application apparatuses according to the invention with translationally slidable rotary profile strips in partial profile section and FIG. 14 the application apparatus according to view A of FIG. 12 in partial longitudinal view.

In all the embodiments according to FIGS. 1 to 14 a sliding holder connection 5 that comprises recesses and sliding holder elements 51, 52 captively connected with the recesses is provided on the underside of a carrier beam 2 that extends in the longitudinal direction of the application apparatus across the application surface 3. The sliding holder elements are connected to a strip-shaped doctor holding portion 43 that is continuous over the application width and holds the doctor elements 4, 41, 42. A doctor unit 40 constructed in this way is equipped with a magnetisable mass by means of which it magnetically pressable against the application surface 3 and possibly a perforated cylinder rotary screen 10 owing to a magnet bar 11 arranged under the application surface 3. Application substance 9 that is guided in front of the doctor element 4 is applied to the application surface 3 such as a web or the like lying on a magnet bar table or a transport belt by means of the pressed doctor element 4, possibly according to the screen pattern.

Figure 8:
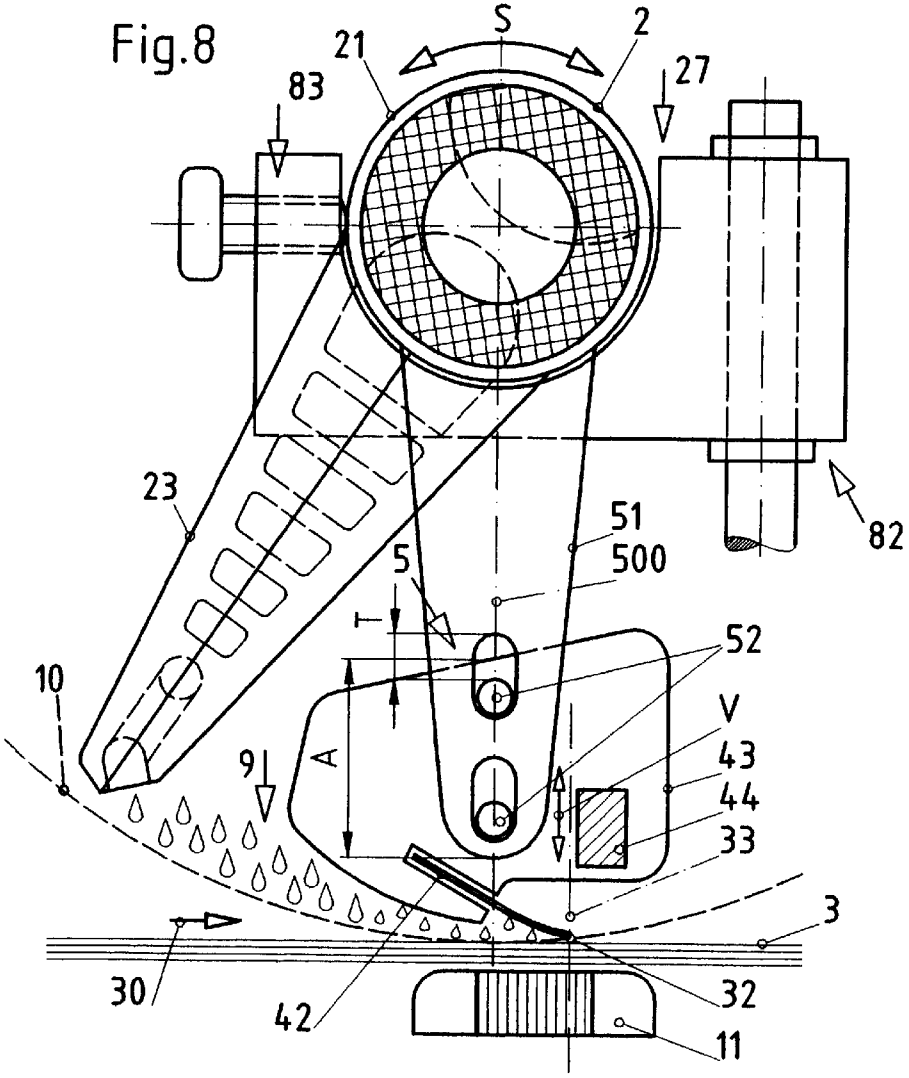

The carrier beam ends are mounted in stationary carrier beam holder bearers of an application or printing machine that are held at a fixed distance from the application surface 3 and are possibly displaceable. The carrier beam 2 is mounted either not to rotate or can be free movingly rotatable about its middle longitudinal axis 20. As shown in FIG. 8, the carrier beam bearers 8 can be equipped with a fixing device 83 in order possibly to fix the carrier beam 2 and thus the whole apparatus in a desired pivotal position.

According to FIGS. 1, 2 and 4 to 7 the holding connection 5 is formed in the manner of a tongue and groove connection, it being ensured that the connection does not clamp and the tongue and groove parts are a sliding fit that is formed in combination with the mutually overlapping sliding holder elements 51, 52 forming the sliding guide plane 500. The play of the sliding fit corresponds to the linear clearance dimension T between the sliding holder element 51 that is arranged on the carrier beam 2 to resist rotation and the sliding holder element 52 connected to the doctor holding portion 43, specifically in the direction transverse to the application surface 3. In this way the maximum clearance dimension T of the holding connection 5 is very small compared to the length of overlap of the sliding holder elements.

According to FIG. 1 the holding connection 5 is provided as an arm sliding guide 50 comprising three plate-like carrier beam holding arms that form sliding holder elements 51, 52, 53. Between the arms 51, 53 there is formed an hole 56 that is T-shaped in cross section and continuous over the apparatus length. A cavity is formed that is flat and slit-shaped in cross section extending perpendicularly from the carrier beam underside towards the application surface 3. The T-shaped head groove 57 extends into the region of the carrier beam 2, and at the other side facing the application surface 3 the cavity 56 is open. The double arm 51, 53 is attached to the carrier beam underside by means of a screw connection or the like.

The doctor holding portion 43 is formed by a substance accumulation profile strip and at the side directed away from the application surface 3 is connected to prevent rotation with a sliding holding portion 52 by means of a screw connection or a detachable plug/bolt connection, the sliding holding portion having the form of a plate continuous over the apparatus length which forms the holding arm 52 for the doctor holding portion 43. At its free end directed towards the carrier beam 2 the holding arm 52 is provided with tongue flange 54 in the form of a T-shaped rail profile. The arm 52 is slid from an end side of the apparatus into the pass cavity 56 that is provided open there. The holding arm 52 lies with its planar arm surfaces freely slidably movable against the cavity walls formed by the holding arms 51, 53.

The holding arm 52 and thus the doctor holding portion 43 are connected together and with the carrier beam 2 to resist rotation and tilting.

According to the invention the doctor unit 40 is arranged to slide translationally, i.e. exclusively rectilinearly in direction V transverse to the application surface, in the sliding guide plane 500 of the holding connection 5. This plane of the sliding guide 50 is formed by the flat slit opening of the pass fit cavity 56. The head groove 57 of the pass fit cavity is large enough such that the T-shaped flange 54 of the holding arm 52 has sufficient play along the sliding plane 500 so that the doctor holding portion 43 is freely slidably movable with adequate clearance T along the plane 500 transverse to the application surface 3.

In the operating position shown in FIG. 1 the guide plane 500 is located in a position perpendicular to the application surface 3. This perpendicular arrangement or an orientation with a steeply inclined position relative to the application surface 3 in which at least the upper part of the holding arm connection 5, when viewed in profile section and in the direction of working movement 30, is behind the device plane 33 that is perpendicular to the working surface 3 and defined by the doctor element contact line 32—see FIGS. 5, 10 and 11—has proved to be particularly advantageous.

According to FIG. 1 the doctor holding portion 43 is in a fixed rigid connection with a doctor blade 42 that forms the doctor element 4, both parts forming the doctor unit 40 that is connected to the holding arm 52 to resist rotation. In the perpendicular position in FIG. 1 the sliding guide plane 500 (to be considered extended) cuts the application surface 3 slightly in front of the said perpendicular device plane 33 when viewed the working direction 30. A magnetisable strip 44 is embedded in the doctor holding portion 43, extends over the length of the holding portion 43 and is arranged such that that it lies predominantly behind the perpendicular device plane 33 when viewed in profile section and in the direction of working movement 30.

In the embodiment according to FIG. 2 the doctor holding portion 43 that is formed by an accumulation profile strip is rigidly connected at its rear side with the lower end of a holding arm 52 when viewed in the working movement directioon 30. This connection can also usefully be constructed with an easily releasable bolt-socket connection.

According to FIG. 3 a further embodiment consists in the doctor holding element 43 being fixed on a plate-like or arm-like sliding holder portion 52 that stands upwardly from the portion 43 in a direction towards the carrier beam 2. The connection of the holding arm 52 with the arm 51 usefully comprises several bolts or pin elements that are arranged mutually spaced over the apparatus length and fit into corresponding long holes. This sliding connection along the planar contact face of the carrier beam holding arm 51 that is is resistant to inclination owing to the fully planar rear contact of the holding arm 52 forms the sliding guide 50 provided according to the invention. It can be useful to connect the arm 51 to the carrier beam 2 with a further sliding guide according to the invention. The path limitation of the sliding connection is obtained by appropriate dimensioning of the long holes. The doctor element 40 can then practically deflect or be positioned by the gradual sliding displacement between the parts 43, 52 and 51. An embodiment also consists in the provision of the planar rear surface of the doctor holding portion 43 as a sliding holder portion. In such a case the sliding guide 50' between the doctor holding portion 43 and the holding arm 52 in FIG. 2 is arranged in a like way to the connection of the parts 51 and 52 in FIG. 3.

According to the embodiment of FIG. 2 the doctor holding portion 43 is provided as a profile strip equipped with a magnetisable doctor of circular cross section which as a stationary rod forms a doctor blade. The doctor blade can be replaced by a doctor roll.

In FIG. 2 the accumulation profile strip 43 is rigidly connected on its longitudinal side to the lower end of a plate-like sliding holder element 52. This again is a plate holding arm with T profile as in FIG. 1. Incidentally the holding connection 5 also corresponds to the guide described with reference to FIG. 1.

Figure 4:
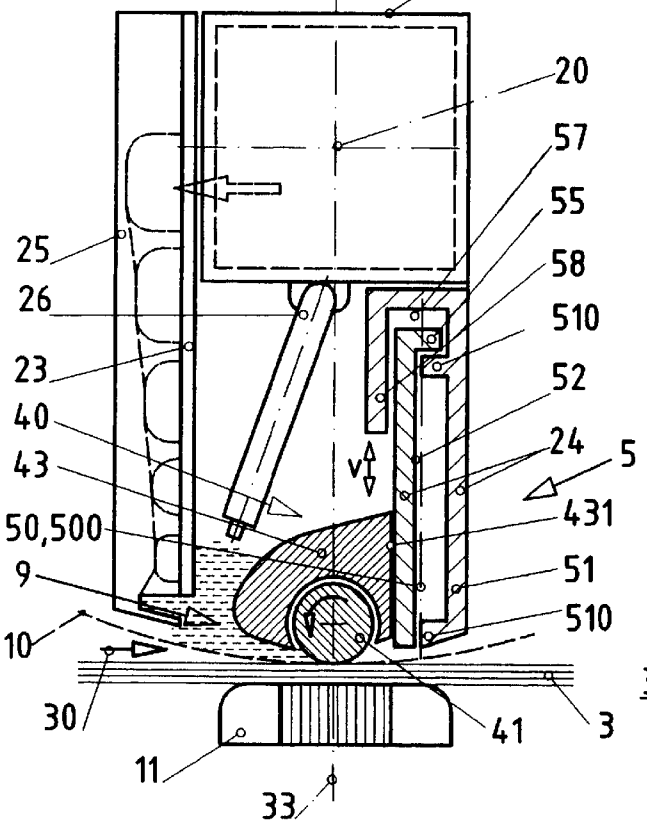

According to FIG. 4 a front wall 23 and a rear wall (back wall) 24, when viewed in the working movement direction 30, are provided on the underside of a tube of a carrier beam 2 of rectangular cross section. The walls 23, 24 project perpendicularly from the undersurface of the carrier beam tube 2 and extend in parallel and parallel with the apparatus longitudinal axis. The free wall edges terminate close to the inner surface of a rotary screen 10. The front wall 23 forms an inner cavity of the apparatus in combination with a plate-like sliding holder element (holding arm) 52 and the doctor holding element 43 that is translationally movable along the slding guide plane 500. The front wall 23 is provided in connection with a flat shaped width distribution strip 25 arranged on edge on the carrier beam tube. By means of this width distribution strip 25, the outlet openings of which lie in the region in front of the doctor roll 41, substance 9 arrives directly in front of the doctor roll 41. In addition a substance contact sensor 26 is provided in the inner cavity between both walls 24, 25 and arranged on the underside of the carrier beam tube, its sensor tip coming to lie in a position that can be modified and set in the region in front of the doctor roll 41.

The doctor holding portion 43 is provided in the form of a substance accumulation profile strip 43 that holds a magnetisable doctor roll 41 with which the doctor unit 40 is formed. A sliding holder element 51 is again formed by a plate-like carrier beam holding arm on which the doctor holding portion holding arm 52 in the form of an L angle part is joined by a plug and slide connection, the latter engaging with its upper short angle part 55 in a corresponding sliding fit recess 57 that is formed on the arm 51 in the region of the carrier beam tube underside with a head angle part 58. The doctor holding portion holding arm 52 is supported against the carrier beam holding arm 51 by strip-like projections 510 and is in parallel sliding arrangement with the carrier beam holding arm 51 along the plane 500. The projections are provided spaced along the arm length. The lower projection is formed by a flange directed against the working direction 30 at the free end of the holding arm 51, while the upper projection is the edge of the groove 57 directed against the working direction 30. The doctor holding portion holding arm 52 lies with the front side of its free end in planar fashion against the angle part 58. The doctor holding portion 43 is connected at its rear planar longitudinal side 431 without overlap with the holding arm 52 to resist rotation. Only a small slit-like opening between the arms 51, 52 and the application surface 3 is formed.

Figure 7:
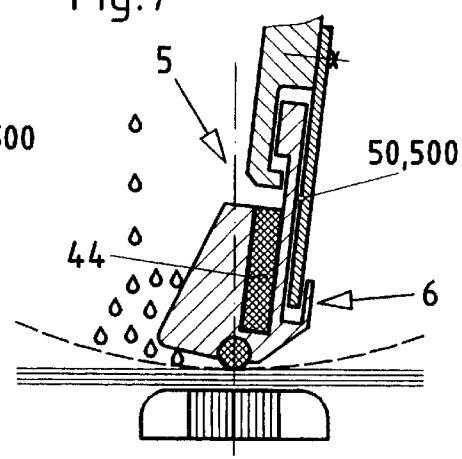
Figure 5:
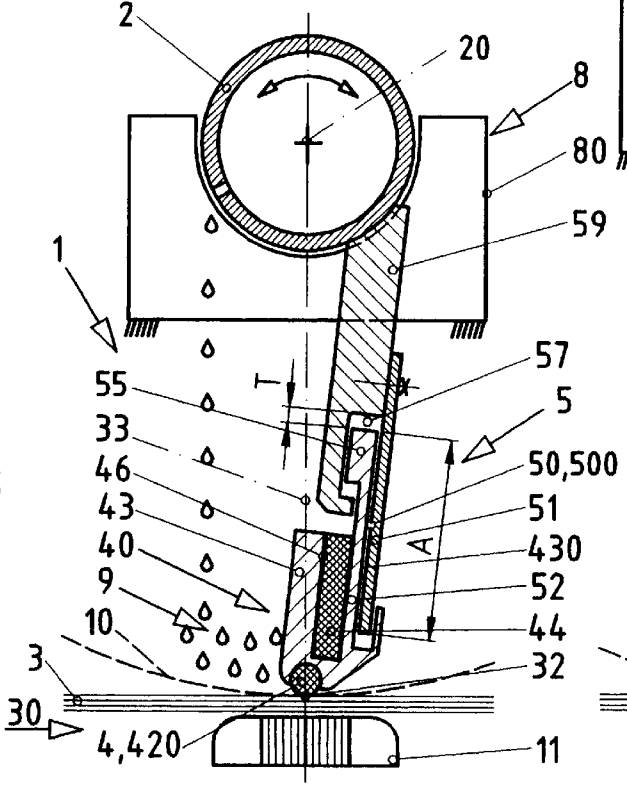

According to the embodiments of FIGS. 5 and 7 the rear portion 430 of the doctor holding portion 43, when viewed in the working direction 30, forms a component part of a sliding holder portion 52 that is in contact with a sliding holder portion 51. The sliding holder portion 51 is formed by a holding arm of the carrier beam 2. A rectangular groove 57 of a pass fit is formed as a longitudinal opening at the free end of a fixing arm 59 that is continuous over the apparatus length and is rigidly connected to a tube of circular cross section that forms the carrier beam 2. The sliding holder portion 51 is provided as a plate that—as a rear arm element of the connection 5—is firmly connected to the fixing arm 59 above the groove 57 with a screw connection or the like, thereby forming the rearward wall of the groove 57. The holding arm 51 that extends to within the region of the application surface 3 forms a planar contact surface against the working movement direction 30 for the planar rear support surface and the sliding surface of the holding arm 52, the planar contact surface defining the sliding guide plane 500. The carrier beam holding arm 51 is the rearmost arm of the sliding connection 5 when viewed in the working movement direction.

The free edge of the holding arm 51 engages in the corresponding U-shaped cross sectional opening of a sliding connection 6 that is formed at the rear side of the doctor holding portion 43 and there at the lower end of the holding arm 52. Thus there is usefully obtained an additional non-rotary connection of the holding portion arms 51, 52 in the direction of a moment acting against the working direction 30 in the region of the doctor element 4, this connection being provided in combination with the pass fit of the parts 55, 57 and the elongate extending rearside overlapping contact of the arms 51, 52. The holding arm portion 51 forms a rear contact surface that engages the doctor holding portion 43 from behind and extends up to the vicinity of the application surface 3.

As apparent from FIGS. 5 and 7 a carrier beam 2 that is freely rotatable about its longitudinal axis 20 is provided in this embodiment. The axis of rotation 20 of the carrier beam lies in the device plane 33 that is defined by the doctor element contact line 32 and is perpendicular to the application surface 3. Nevertheless the sliding guide plane 500 of the arm connection 5 is advantageously located in a steeply inclined position relative to the application surface 3, the carrier beam holding arm 51 being rigidly connected with the carrier beam 2 in the region behind the device plane 33 by means of the fixing arm 59. In connection with the sliding arm connection 5 that is thus arranged in a steeply inclined position behind the device plane 33 it is particularly useful and advantageous to provide a magnetisable strip 44 that is exchangably insertable or firmly embedded in an opening 46 of the doctor holding portion 43, the magnetisable mass of the strip lying entirely in the region behind the device plane 33 in every positioning and working position.

Figure 6:
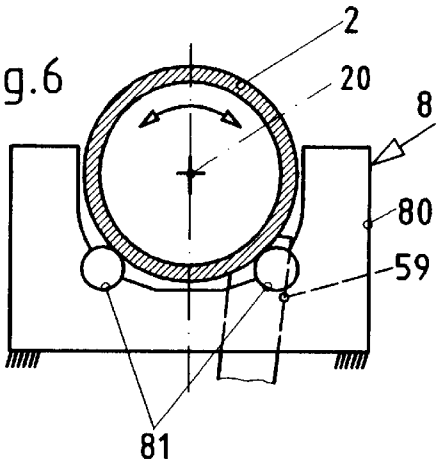

Apparatus according to the invention of FIGS. 5 to 7 are in additionally particularly well suited for use with doctor elements 4 of circular cross section, particularly those of relatively small diameter, namely preferably with diameters in the range from 3 to 10 mm. Non-rotary round rods with diameters of 3 to 6 mm can also usefully be used. The said doctor elements can usefully be held captive, but nevertheless exachangeably, in clamping or glide recesses of the doctor holding portion. Particularly advantageous application results can be obtained in combination with a substance profile surface as is provided on the doctor holding portion 43 according to FIG. 7.

In FIGS. 5 and 6 carrier beam pivot bearings 8 are shown which are arranged at the end faces of the apparatus and are firmly connected to the latter. The ends of the tube carrier beam 2 of circular cross section are easily and freely rotatable in bearing blocks 80 of the bearing 8. According to FIG. 5 the bearing block 80 comprises a conventional bearing seat. FIG. 6 shows a special bearing that is particularly well suited for the purposes of the invention. The bearing block 80 is equipped with two parallelly extending bearing rods 81 of circular cross section that are firmly connected to the bearing block 80. As a result of only the linear contact of the carrier beam outer surface with the stationary, i.e non-rotary, rods 81 there is obtained a particularly pronounced free rotary movability of the carrier beam 2. It has been found that with the optimisation of the free carrier beam rotary movability in combination with the elongate overlapping, non-inclining holding arm sliding connection, the positioning of the doctor unit 40 can be still further improved. The rod bearing has proved to be particularly advantageous with carrier beams with round rods and particularly for application widths of several meters because the easy-running of the bearing is not affected by deformation of the beam. Even slight differences in height between both bearing blocks 80 at the end faces of the apparatus do not have a disadvantageous effect. Moreover all lubricants used for conventional bearings can be dispensed with, and the rotary movability will not be effected when soiling or clogging with colour substance occurs.

As for the T-rail portion of the sliding holder portion 52 according to FIG. 1, the P-shaped cross sectional tongue flange of the sliding holder portion 52 according to FIGS. 5 and 7 is also inserted or slid from the end face into the groove 57 so that a releasable connection is obtained that nevertheless holds the parts captive. As apparent with reference to FIG. 2 the bearing profile portions of the sliding guide 50 can also usefully be exchangeably joined on the carrier beam underside advantageously by means of a plug or clamp connection in a corresponding clamp connection opening 22.

The embodiment according to FIG. 8 shows a further arrangement of a holding connection 5 in connection with a accumulation profile strip that forms a doctor holding portion 43. In this case the profile strip 43 is held at end faces between strip- or rod-like holding arms that form sliding holder elements 51 and are connected to rotate with a carrier beam 2 mounted for rotation. The sliding guide plane 500 which, depending on the operating state, stands perpendicular or nearly perpendicular to the application surface 3 is formed in that long holes are worked into each holding arm 51 flush with the plane, bolts, pins, pegs or the like disposed on the end face of the profile strip 43 engaging with the long holes. Pairs of these pins at an end face form the sliding holder elements 52 arranged on the doctor holding portion 43. In order to obtain the dimension of clearance T sufficient play is left along the long holes. The profile strip 43 carries a doctor blade firmly connected with itself, the doctor blade usefully being joined such that it may be exchanged.

A magnetisable strip 44 is embedded in the profile strip 43 and lies, as viewed in the cross section of the profile strip and in the direction of movement 30, entirely behind the device plane 33 that is defined by the doctor element contact line 32 and perpendicular to the application surface 3 for every working position of the rotary profile strip 43.

With reference to FIG. 8 there is shown a carrier beam holding device 27 that is arranged at the end face of an application or printing machine with bearing seats in which the carrier beam ends 21 of the carrier beam 2 having a circular cross section in this embodiment are held for easy rotation. After self-positioning that is achieved magnetically the rotary position of the carrier beam 2 and thus the sliding guide plane 500 can be fixed by means of a fixing device 83. Preferably the bearings of the carrier beam holding device 8 are arranged to be height adjustable by means of an adjustment device 82. In this way the sliding bearings forming the sliding guide 5 can be positioned at a desired distance from the application surface 3.

Figure 9:
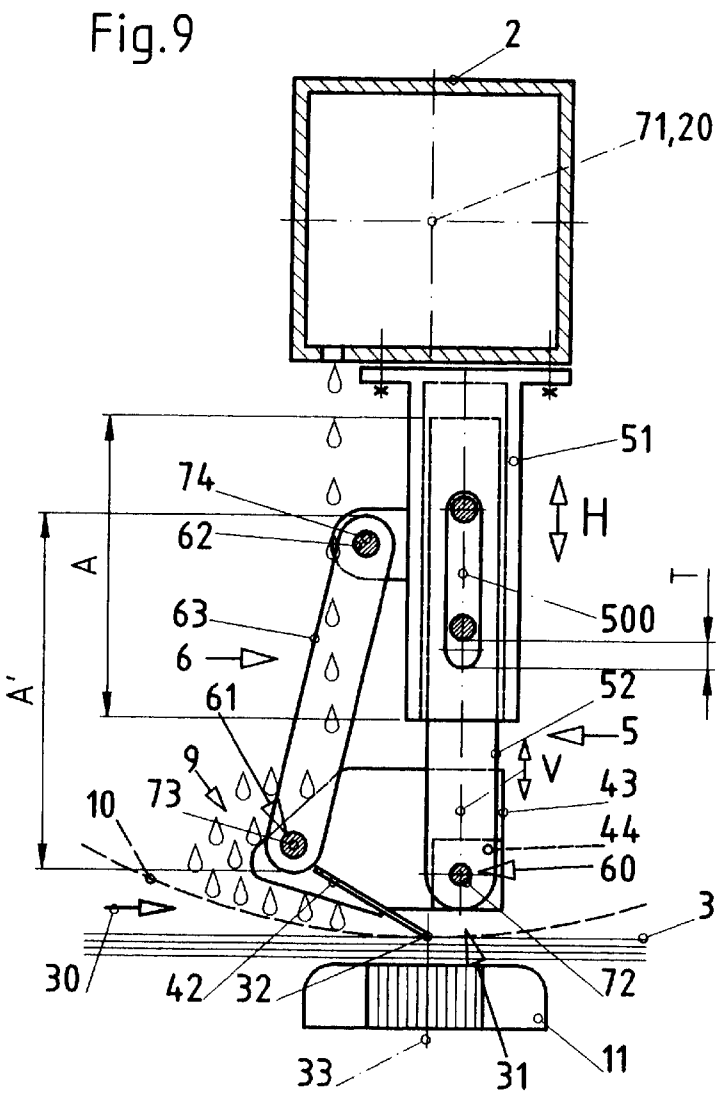

In a similar manner as for the embodiment according to FIG. 8 a sliding guide 50 of the apparatus in FIG. 9 is connected with the end sides of a doctor holding portion 43. The sliding guide 50 comprises sliding holding elements 52 in the form of a pair of rod or strip-like holding arms that are connected with the end faces of the doctor holding portion 43. A sliding holding element 51 connected to the carrier beam 2 is associated with each doctor holding portion holding arm 52. The sliding holding element is formed by an arm-like part that is firmly connected to the carrier beam 2 by means of a screw connection or the like and extends down to the region of the doctor holding portion 43. A bearing seat forming a straight guide in which the doctor holding portion holding arm 52 engages in a sliding-movable manner is formed in the arm-like part, the arm 52 being connected with the carrier beam holding arm 51 to prevent relative rotation and tilting. The holding arm 52 is captively held and the clearance dimension T limited by a long hole that is flush with the sliding plane 500 of the sliding guide 50 in the sliding direction in connection with a pair of pegs that are firmly provided on the bearing seat and engage in the long hole.

A special feature of the embodiment according to FIG. 9 is that the doctor holding portion 43 is provided as a rotary profile strip. This is held to move pivotally by two parallel rotary bearing axles 72, 73 that extend in the application length.

The first rotary axis 72 is formed in that the rotary profile strip 43 is held and coupled by means of rotary bearings 60 at the free lower end of the holding arms 51 in the region of the doctor element contact zone. The first rotary bearing axle 72 lies in the sliding guide plane 500 (to be considered extended). The second rotary bearing axle 73 is formed by a coupling bearing in the form of a rotary bearing 61 that is likewise arranged at the end face on the rotary profile strip 43. The pivot bearing couples the rotary profile strip 43 at a lever distance from the first rotary bearing axle 72, the coupling in the embodiment, when viewed in the working movement direction 30, occuring in front of the device plane 33 that is defined by the plane perpendicular to the application surface 3 along the doctor element contact line 32. The coupling connection 6 comprises a link arm 63 that with one of its ends couples the profile strip 43 about the second rotary axle 73 and is itself pivotally coupled to the carrier beam 2 at its other end by means of a pivot bearing or hinge joint 62, specifically to the holding arm 51 that is rigidly connected to the carrier beam 2. The rotary profile strip 43 is equipped with a doctor blade by means of which the doctor unit 40 is formed.

A magnetisable strip 44 or a corresponding magnetisable block that acts over the application width is embedded in the rotary profile strip 43. The guide plane 500 of the sliding guide 50 again takes up its positions perpendicular and nearly perpendicular to the application surface 3. Positioning and stabilising occur over a range of steep angles between the sliding guide plane 500 and the application surface 3.

The angular position of the doctor blade 42 relative to the application surface 3 can be modified and set by adjusting the height H of the carrier beam 2 by means of the coupling connection 6. When considering the end view of FIG. 9 the rotary profile strip 43 turns clockwise about the first rotary bearing axle 72 when the carrier beam 2 is raised or anti-clockwise when lowered. The accumulation profile strip surface in front of the doctor element contact zone 32 acting on the substance 9 is thereby adjusted.

An advantage of the invention consists in that stabilising and positioning of the rotary profile strip 43 occur without influence on its angular position. This is achieved in that the first rotary bearing axle 71 lies constantly in the sliding guide plane 500 (to be considered extended) so that the pivot bearing 60 is held perpendicular or transverse to the application surface to move exclusively translationally along the sliding guide plane 500. Although not necessary, it is useful and advantageous to mount the carrier beam 2 for free rotation about its longitudinal axis 20. By means of such a bearing, preferably equipped with a fixing device 83 as in FIG. 8, the doctor holding portion 43 is held to rotate about a third of an axis 71 that corresponds to the carrier beam axis 20 and with which the guide plane 500 is also pivotally coupled.

Figure 11:
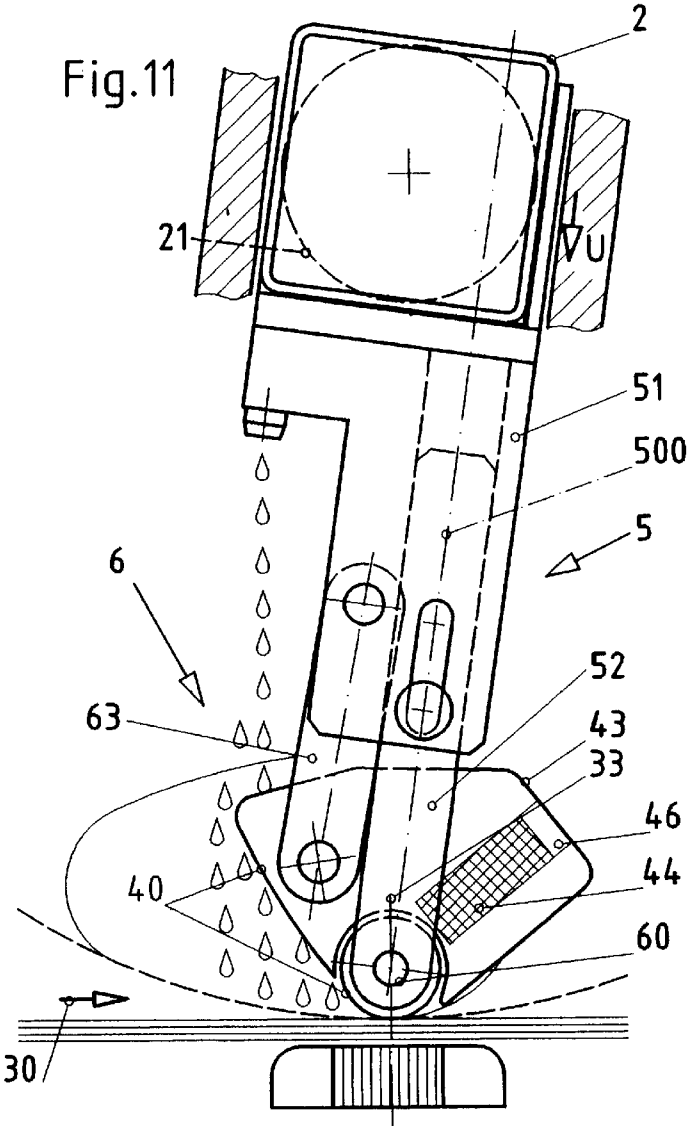
Figure 10:
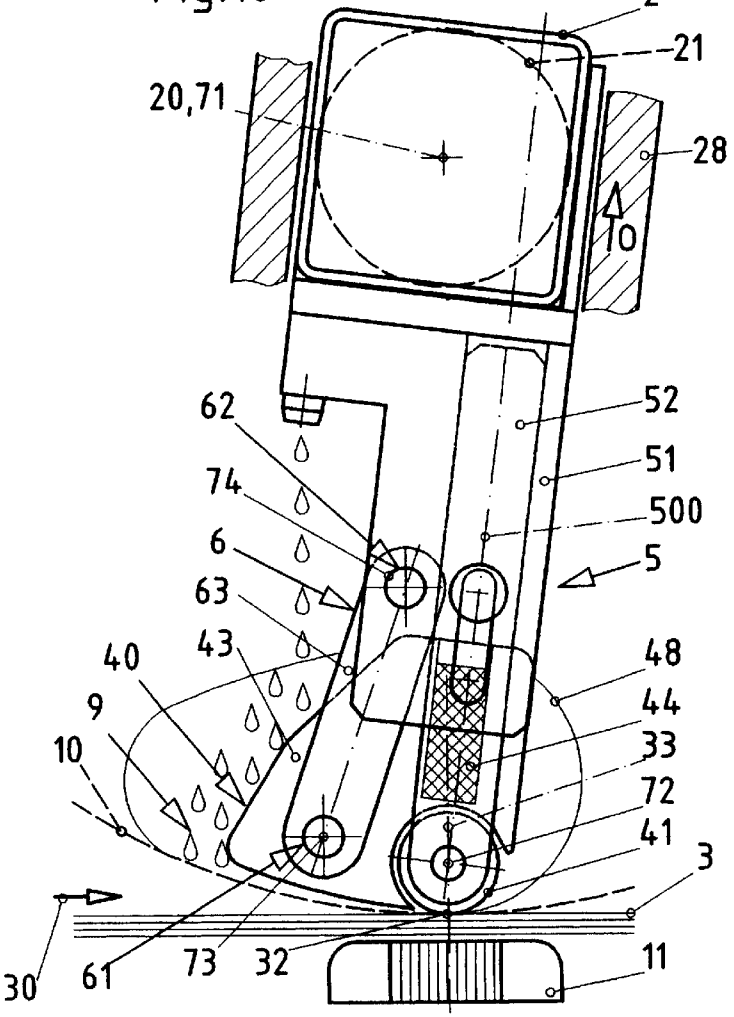

FIGS. 10 and 11 show an embodiment of an apparatus according to the invention with a doctor unit 40 that is formed by a doctor holding portion 43 in the form of a rotary profile strip and a doctor roll 41. A sliding guide 50 is formed as for the embodiment according to FIG. 9. During operation the sliding guide plane 500 is held by an inclined bearing 28 in a steeply inclinded position relative to the application surface 3. A special feature is that the rotary bearing 60 that is translationally movable along the sliding guide plane 500 is arranged such that its rotary bearing axle 72 coincides or nearly coincides with the pivot axis of the doctor roller 41. To this end the doctor roll 41 can be provided at its end faces with pegs that fit positively into circular bearing seats of the pivot bearing 60.

A further useful arrangement that is not shown consists in the provision of plates at the end faces of the rotary profile strip, on which plates rotary pegs for the bearing 60 are formed which do not need to be flush with the pivot axis of the doctor roll 41 but should lie in the vicinity of doctor roll axis in parallel extension. The doctor roll will then be captively but removablely held in the pivot bearing seat of the profile strip that has identical cross section.

In FIG. 10 the carrier beam 2 is shown in its maximally lowered position to form a flat substance inlet slot in front of the doctor element contact line 32. According to FIG. 11 the carrier beam 2 is shown in its maximally raised position, in which the rotary profile strip 43 is brought into its maximally upwardly swung position about the first rotary bearing axle 72 by means of the coupling connection 6. Raising the carrier beam 2 in direction O or lowering in direction U occurs by means of suitable not shown carrier beam holder means. By means of carrier beam ends 21 of circular cross section shown by a dashed line pivotal bearing about the carrier beam axis 20, 71 can occur—for example after removing the inclined bearing 28 during operation.

In order to permit magnetic engagement of the doctor unit 40 the latter is equipped with a magnetic strip 44 that in every working position of the rotary profile strip 43, when viewing the profile strip in cross section and in the direction of movement 30 of the application surface 3, lies predominantly in the area behind the device plane 33 that is perpendicular to the application surface 3 and defined by the doctor element contact line 32. The magnetisable strip 44 is of flat-shaped cross section and extends radially on edge relative to the axis 72 above the doctor roll 41. It is also removably inserted in the longitudinal hole 46 of the profile strip 44. This has the advantage that the magnetically active mass can be comfortably modified by using differently magnetisable strips and exchanging them.

All in all the apparatus according to FIG. 9 permits the modification of the doctor angle with the advantage of stabilization of positioning.

In FIGS. 10 and 11 substance limiting plates 48 are shown arranged at the end faces and are provided in the usual manner here as for the other embodiments.

Figures 12, 13, 14:
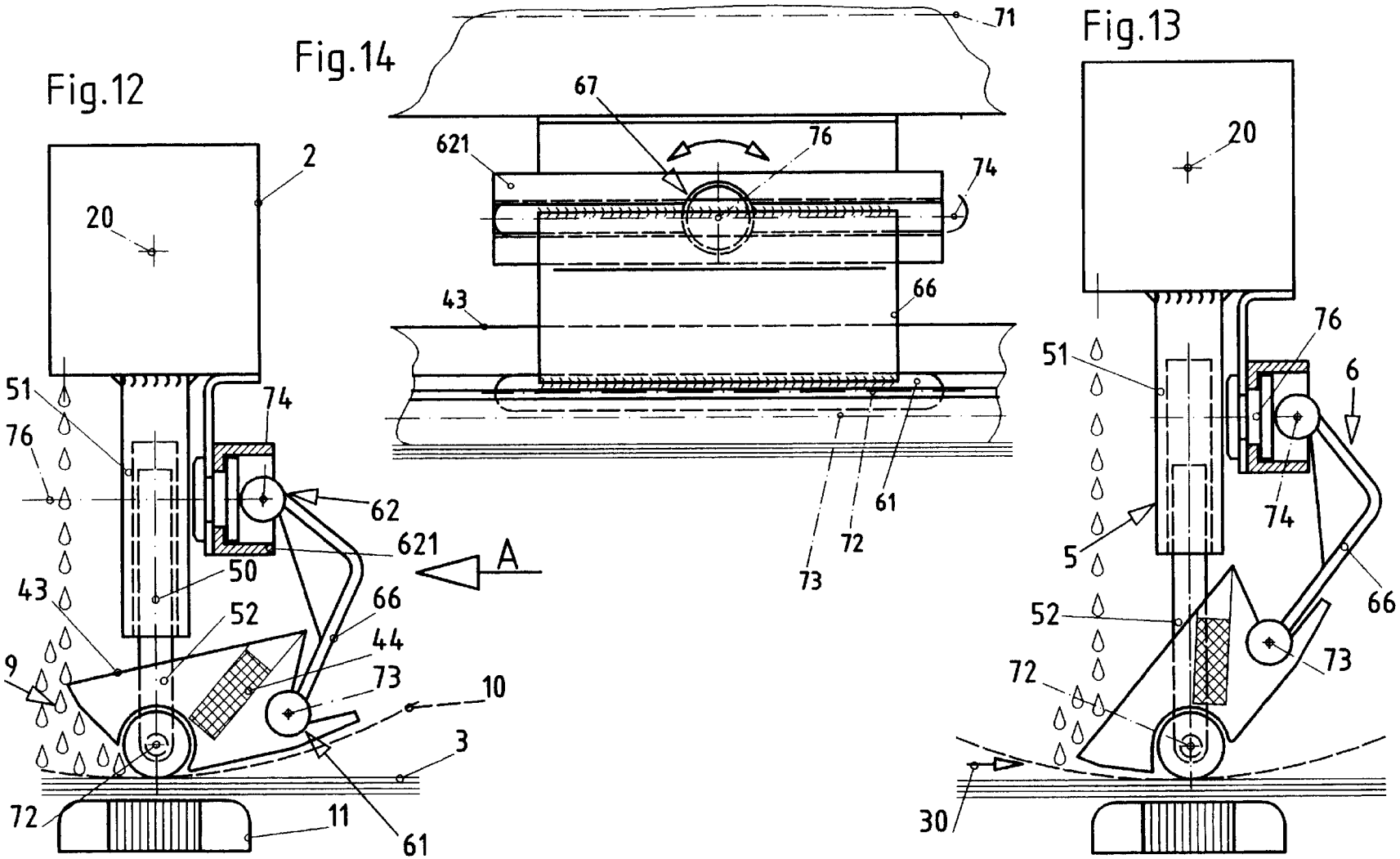

FIGS. 12 to 14 show another arrangement of a coupling connection 6. This comprises an angle arm 66 that is arranged between a rotary profile strip 43 and a carrier beam 2 and is connected with the carrier beam 2 by a hinge joint 62, the hinge joint 62 being arranged such that its height relative to the application surface 3 may be adjusted and fixed. In addition, the hinge joint 62 is fixed for rotation halfway along the length of the carrier beam 2 about an axis 76 perpendicular to the apparatus longitudinal axis by means of a pivot coupling 67.

FIG. 14 shows the apparatus according to FIG. 12 in view A. As apparent particularly from FIG. 14 the bearing 62 is formed by means of a hinge double joint strip 621, an elongate groove being formed in an elongate beam and forming the bearing seat for an elongate bearing rod fixed to the angle arm 66. The coupling strip 621 is mounted to pivot about the axis 76 halfway along the apparatus length by a holding portion firmly connected to the carrier beam 2. The height adjustment occurs by means of the carrier beam 2, FIG. 12 showing the maximum downward swing position of the rotary profile strip 43 and FIG. 13 the maximum upward swing position of the rotary profile strip 43.

In the embodiment according to FIGS. 10 to 14 the doctor roll advantageously comprises a diameter of between 5 to 12 mm.

It has also been found that very advantageous results can be achieved when the perpendicular distance of the first rotary bearing axle 72 to the application surface 3 lies in the region of 4 to 20 mm. Tests have also shown that the perpendicular distance of the second rotary bearing axle 73 to the application surface in the lowered position of the rotary profile strip 43 preferably lies in the range from 10 to 20 mm, while a perpendicular distance in the highest upward swing position of the rotary strip is preferably provided in the range from 20 to 50 mm.

All in all the connection of the doctor unit 40 with the carrier beam 2 according to the invention is advantageous in several aspects. On the one hand the magnetically induced self-positioning of the doctor unit 40 can occur with an easily rotatably movable carrier beam before commencement of operation. Then during doctor operation no rotary action is necessary. On the other hand the carrier beam 2 can be installed in a fixed predetermined position, i.e. arranged in a non-rotary position. With the connection according to the invention the position of the doctor unit 40 is stabilised in an optimum manner during the doctor operation.

I claim:

1. Applicator apparatus (1) for applying substance (9) to an application surface (3) comprising a carrier beam (2) extending in a longitudinal direction of the apparatus over an application width, with a doctor holding portion (43) supporting a doctor element (4), the doctor element (4) and the doctor holding portion (43) forming a doctor unit (40) that is magnetically pressable against the application surface (3), and with a holding connection (5) that produces play in a direction transverse to the application surface (3) between carrier beam (2) and doctor unit (40), wherein the holding connection (5) between carrier beam (2) and doctor element (40) comprises at least a pair of exclusively translatorily movable, mutually engaging sliding holder elements (51, 52) which form a sliding guide plane (500) adjustable to the region of a zone of contact (31) of the doctor element, the sliding holder elements (51, 52) being tilt-resistantly connected together such that the moments, which arise as a result of the thrust acting on the doctor unit (40) during doctor operation, act without loss of moment with regard to a point of application on the carrier beam.

2. Apparatus according to claim 1, wherein the connection of the doctor unit (40) with the corresponding sliding holder element (52), of the sliding holder elements (51, 52) to each other and/or of the carrier beam (2) with the corresponding sliding holder element (51) is formed in a modular manner as a detachable plug, hook and/or sliding connection.

3. Apparatus according to claim 1, wherein the sliding holder elements (51, 52, 53, 63, 64, 66) are plate shape arm elements that have an arm width corresponding to the application width and/or are rod shape arm elements arranged in an end face area of the apparatus.

4. Apparatus according to claim 1, wherein the holding connection (5) is arranged such that the sliding guide plane (500) can be moved to pivot in a position in which it intersects the application surface (3) in the area of the doctor element contact zone (31) perpendicularly or nearly perpendicularly.

5. Apparatus according to claim 1, wherein a rearmost sliding holder element of the holding connection (5), when viewed in the working movement direction (3), is a sliding holding element (51) connected to the carrier beam 92) without relative rotation.

6. Apparatus according to claim 1, wherein overlapping sliding holder elements (51, 52) of the holding connection (5) extend up to behind the doctor holding portion (43), when viewed in the working movement direction (3), and there form a rear support surface for the doctor holder portion (43).

7. Apparatus according to claim 6, wherein a rearward portion (430) of the doctor holding portion (43), when viewed in the working movement direction (30), is a component part of a sliding holder element (52) that projects from the doctor holding portion (43) towards the carrier beam (2) and lies against a sliding holder element (52) that projects from the carrier beam (2), the doctor holding portion (43) usefully being formed at its head in the shape of at least one of a holding strip and as a profile strip with an substance accumulation surface.

8. Apparatus according to claim 5, wherein a sliding holder element 52) that is connected to the doctor holding portion (43) to resist relative rotation lies without overlap against a free end portion of the rearmost sliding holder element (51) of the carrier beam.

9. Apparatus according to claim 1, wherein a connection (6) is formed between the free end of a sliding holder element (51) that is connected to the carrier beam (2) and the doctor holding portion (43), the connection connecting the free end of the carrier beam sliding holder element (51) to the doctor holding portion (43) without relative rotation.

10. Apparatus according to claim 1, wherein the sliding holding elements (51, 52, 53) are plate shape parts that lie against one another directly or indirectly by means of projection (510) in parallel planar arrangement in sliding connection.

11. Apparatus according to claim 1, wherein the carrier beam (2) comprises two walls (23, 24) extending parallel with the carrier beam and projecting from the carrier beam underside, the walls reaching with their free edges to close to the application surface (3), a cavity that defines the amount of substance in front of the doctor holding portion (43) being formed between the walls (23, 24) and the rear wall (24), as viewed in the working movement direction (30), being formed by the sliding holder elements (51, 52) of the arm connection (5).

12. Apparatus according to claim 1, wherein the doctor holding portion (43) is a rotary profile strip that is held for rotation about two bearing axles (72, 73) extending in the apparatus length, a first rotary bearing axle (72) being formed by an axle that lies in, or proximate to, the sliding guide plane (500) and in the region of the doctor element contact zone (31), and the rotary profile strip (43) being coupled hinged by means of a second pivot bearing axle (73) to a coupling member (63) of a coupling connection (6), the coupling member being coupled to the carrier beam (2) about at least a further pivot bearing axle (74) extending in the apparatus length.

13. Apparatus according to claim 12, characterised in that a rotary bearing (60) is formed on each end side of the rotary profile strip (43) between the profile strip end surfaces and a sliding holding element (51) that is translationally slidable by means of the sliding guide (50), the rotary axle of the rotary bearing preferably forming the first rotary bearing axles (72) in the shape of pegs.

14. Apparatus according to claim 12, wherein the coupling connection (6) between the rotary profile strip (43) and the carrier beam (2) comprises an arm that forms an angled arm (63) as a coupling member, the arm being connected with the carrier beam (2) by a hinge joint (62), the hinge joint (62) being arranged height adjustable and fixable relative to the application surface (3).

15. Apparatus according to claims 12, wherein the coupling connection (6) between doctor holding portion (43) and carrier beam (2) comprises at least three rotary joints (61, 62, 67), two rotary joints (61, 62) forming rotary bearing axles (73, 74) with parallel longitudinal axes and one rotary joint (67) forming a rotary bearing axle (76) that is perpendicular to the longitudinal axis of the apparatus and is arranged halfway along the length of the carrier beam (2).

16. Apparatus according to claim 1, wherein the holding connection (5) is arranged such that in every working position of the doctor holding portion (43), when the profile strip is viewed in cross section and in the direction of movement (30) of the application surface (3), it lies predominantly or fully in the region behind the device plane (33) that is perpendicular to the application surface (3) and defined by a doctor holding element contact line (32).

17. Apparatus according to claim 1, wherein a the free end of a sliding holding element (52) connected to the doctor holding portion (43) is provided with a flange-shaped or strip-shaped element (54, 55) that engages in a corresponding groove (57) of a sliding fit.

18. Apparatus according to claim 1, wherein a the maximal clearance dimension (T) of sliding connection (5) is very small relative to an overlapping length (A) of the sliding holder elements (51, 52, 53).

19. Apparatus according to claim 1, wherein the doctor holding portion (43) comprises a non-magnetisable strip structure that is connected along its structure length with a magnetisable mass in the shape of a magnetisable strip (44) or in the shape of magnetisable portions arranged physically spaced from one another in a row, the magnetisable mass is arranged such that in every working position of the doctor holding portion (43), when the profile strip is viewed in cross section and in the direction of movement (30) of the application surface (3), it lies fully or at least predominantly in the region behind a device plane (33) that is perpendicular to the application surface (3) and defined by a doctor holding element contact line (32).

20. Apparatus according to claim 1, wherein the carrier beam (2) is held for free rotation by means of a rotary bearing (8), the rotary bearing (8) preferably comprising two rod-shaped or needle-shaped bearing portions (81) that extend in parallel with the apparatus length and on which the carrier beam (2) with a circular cylindrical outer surface is mounted to be freely rotatable.

21. Apparatus according to claim 1, wherein the carrier beam (2) is held by means of a holding device (27) with which its position can be firmly set.

* * * * *